US007574869B2

(12) United States Patent
Shapiro

(10) Patent No.: US 7,574,869 B2
(45) Date of Patent: Aug. 18, 2009

(54) REFRIGERATION SYSTEM WITH FLOW CONTROL VALVE

(75) Inventor: Doron Shapiro, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 482 days.

(21) Appl. No.: 11/457,081

(22) Filed: Jul. 12, 2006

(65) Prior Publication Data

US 2007/0089454 A1 Apr. 26, 2007

Related U.S. Application Data

(63) Continuation-in-part of application No. 11/254,617, filed on Oct. 20, 2005, now abandoned.

(51) Int. Cl.
*A47F 3/04* (2006.01)

(52) U.S. Cl. ..... 62/117; 62/196.4; 62/246

(58) Field of Classification Search ..... 62/196.4, 62/198–200, 246–256, 117
See application file for complete search history.

(56) References Cited

U.S. PATENT DOCUMENTS

| | | | | |
|---|---|---|---|---|
| 2,277,999 | A | 3/1942 | Thompson | |
| 3,210,957 | A | 10/1965 | Rutishauser et al. | |
| 3,487,656 | A | 1/1970 | Grant | |
| 3,848,425 | A | 11/1974 | Watkins | |
| 3,874,187 | A | 4/1975 | Anderson | |
| 4,104,890 | A | 8/1978 | Iwasaki | |
| 4,341,086 | A | 7/1982 | Ishii | |
| 4,550,574 | A | 11/1985 | Hohman | |
| 4,748,820 | A | 6/1988 | Shaw | |
| 4,788,826 | A | 12/1988 | Higdon | |
| 4,979,371 | A * | 12/1990 | Larson | 62/81 |
| 5,007,247 | A | 4/1991 | Danig | |
| 5,065,591 | A * | 11/1991 | Shaw | 62/175 |
| 5,271,248 | A | 12/1993 | Crowe | |
| 5,440,894 | A | 8/1995 | Schaeffer et al. | |
| 5,493,875 | A | 2/1996 | Kozinski | |
| 6,067,482 | A * | 5/2000 | Shapiro | 700/286 |
| 6,116,040 | A | 9/2000 | Stark | |

(Continued)

OTHER PUBLICATIONS

Refrigeration systems publicly known prior to Oct. 20, 2005, as described in the attached Statement of Relevance, 3 pages.

*Primary Examiner*—William E Tapolcai
(74) *Attorney, Agent, or Firm*—Michael Best & Friedrich LLP

(57) ABSTRACT

A control valve to regulate flow of refrigerant through a refrigeration system that includes a plurality of refrigerated display cases. Each of the plurality of display cases includes a dedicated evaporator that cools return air by at least partially evaporating a refrigerant. A compressor assembly compresses evaporated refrigerant received from the plurality of evaporators. The system further includes a condenser located remotely from the plurality of display cases that rejects heat from the refrigerant to an environment. A gas main is in fluid communication with an inlet of the condenser and directs refrigerant from the compressor assembly to the condenser. A liquid main is in fluid communication with an outlet of the condenser and directs refrigerant from the condenser to the plurality of evaporators. The valve is fluidly coupled between the gas main and the liquid main, and regulates flow of refrigerant from the gas main to the liquid main.

18 Claims, 5 Drawing Sheets

U.S. PATENT DOCUMENTS 6,244,060 B1 * 6/2001 Takano et al. ..... 62/196.4
6,467,298 B2 10/2002 Schulak
6,772,600 B2 * 8/2004 Hwang ..... 62/160
6,889,514 B2 5/2005 Lane et al.
7,003,971 B2 2/2006 Kester et al.
7,013,664 B2 * 3/2006 Matsumoto et al. ..... 62/278
2004/0074246 A1 * 4/2004 Kurata et al. ..... 62/196.4
2005/0097918 A1 * 5/2005 Thurman ..... 62/468

* cited by examiner

REFRIGERATION SYSTEM WITH FLOW CONTROL VALVE

CROSS REFERENCE TO RELATED APPLICATIONS

This patent application is a continuation-in-part of and claims priority to U.S. patent application Ser. No. 11/254,617, filed on Oct. 20, 2005, the entire contents of which are incorporated by reference herein.

BACKGROUND

The present invention relates to refrigeration systems. More specifically, the present invention relates to refrigeration systems for refrigerated display cases for displaying products in a commercial application.

A retail store, such as a supermarket, typically contains many refrigerated display cases for displaying and cooling food and/or beverage items for sale. Many types of refrigerated display cases are known in the art, and are in extensive use in retail locations. Such refrigerated display cases require a refrigeration system to maintain a temperature within the display case that is lower than ambient temperature inside the store.

Refrigeration cycles are well-known in the art and generally include an evaporator, a compressor, and a condenser. A refrigerant fluid flows from one component to the next, exchanging heat so as to absorb heat from a refrigerated area and reject heat at the condenser, typically experiencing a phase change during the cycle.

A first prior art refrigeration system 20 is shown in FIG. 1. The refrigeration system 20 includes refrigeration units 24 that are each dedicated to a respective refrigerated display case 28. The refrigeration unit 24 for each refrigerated display case 28 includes a compressor (not shown) and a water-cooled condenser (not shown). The water-cooled condenser is cooled by a coolant fluid, typically a water/glycol mixture that is provided by a closed coolant loop 32 with associated coolant pumps 36. All the refrigerant for the refrigeration system is contained within the components of the refrigeration units 24, and a respective evaporator (not shown) in each refrigerated display case 28. Refrigerant fluid is heated and expanded in the evaporator as it removes heat from the refrigerated display case 28. The compressor compresses the heated refrigerant and forces it to flow to the water-cooled condenser in the refrigeration unit 24. The water-cooled condenser transfers heat from the refrigerant fluid to the coolant fluid, allowing the refrigerant fluid to condense, pass through an expansion valve, and return to the evaporator to be heated and expanded in a cyclical manner. The coolant pumps 36 in the closed coolant loop 32 force the cooling water/glycol mixture to flow to the water-cooled condenser from a heat exchanger 40 (e.g., an air-cooled fluid cooler), which is typically remotely located. At the heat exchanger 40, the coolant fluid is cooled and then returned to the water-cooled condenser to receive heat from the refrigerant fluid.

A second prior art refrigeration system 44 is shown in FIG. 2. Each refrigerated display case 52 includes an evaporator 56 for removing heat from each refrigerated display case 52. Evaporated refrigerant is routed from the evaporators 56 via a suction header 58 to a local bank of compressors 60 and then through a discharge header 62 to a remotely located condenser 64 to be condensed. Condensed refrigerant is routed from the condenser 64 via a liquid header 57 to the evaporators 56. The local bank of compressors 60 is located either at the end of a group or directly atop a group of refrigerated display cases 52 and contains several compressors connected in parallel within a sound-attenuated casing 66. The suction header 58 and the discharge header 62 are partially located within the sound-attenuated casing 66. The discharge header 62 establishes fluid communication between the local bank of compressors 60 and the condenser 64 and is not necessarily positioned adjacent each refrigerated display case 52. Similarly, the liquid header 57 establishes fluid communication between the evaporators 56 and the condenser 64, and is not necessarily positioned adjacent each refrigerated display case 52. The local bank of compressors 60 serves to compress heated refrigerant from several evaporators 56. The remotely located condenser 64 receives heated refrigerant from a single local bank of compressors 60.

A third prior art refrigeration system (not shown) is disclosed in U.S. Pat. No. 4,748,820. The third prior art refrigeration system includes a bank of centralized compressors located in an "equipment room" of a building, remotely located from a group of refrigerated display cases. The bank of centralized compressors supply compressed heated refrigerant gas via a discharge line to a condenser typically positioned outside of the building. From the condenser, cooled liquid refrigerant is routed via a liquid refrigerant line to evaporators positioned within the refrigerated display cases to cool a portion of each case. The evaporated refrigerant gas is then routed to a local booster compressor and then back to the bank of centralized compressors in the equipment room via individual suction lines from each refrigerated display case to repeat the cycle. The individual suction lines converge prior to the bank of centralized compressors in an interstage manifold located in the equipment room.

Upon startup or after a power outage of typical refrigeration systems, one or two small compressor units discharge refrigerant into a relatively long discharge header. Often, refrigerant in the room-temperature discharge header will condense and fill the discharge header with liquid refrigerant. In refrigeration systems that include a finite amount of refrigerant, the reduced availability of liquid refrigerant in the liquid header may be inadequate to properly cool the display cases. The reduced availability of refrigerant in the liquid header causes low suction in the system and may result in compressor shutoff due to very low suction pressures.

SUMMARY

In one embodiment, the invention provides a refrigeration system that includes a plurality of refrigerated display cases. Each of the plurality of refrigerated display cases includes a dedicated evaporator that cools return air from the respective refrigerated display case by at least partially evaporating a refrigerant. A compressor assembly is in fluid communication with the plurality of evaporators and compresses the evaporated refrigerant. The system further includes a condenser located remotely from the plurality of refrigerated display cases that rejects heat from the refrigerant to an environment. A gas main is in fluid communication with an inlet of the condenser and directs refrigerant from the compressor assembly to the condenser. A liquid main is in fluid communication with an outlet of the condenser and directs refrigerant from the condenser to the plurality of evaporators. A valve is fluidly coupled between the gas main and the liquid main to regulate flow of refrigerant from the gas main to the liquid main.

In another embodiment the invention provides a method of operating a refrigeration system that includes a plurality of refrigerated display cases each having a dedicated evaporator. The method includes cooling return air from each of the plurality of refrigerated display cases by at least partially evaporating a refrigerant in each of the dedicated evaporators, compressing the evaporated refrigerant, and directing the compressed refrigerant through a gas main to a condenser. The method further includes condensing the compressed refrigerant in the condenser, directing the condensed refrigerant through a liquid main in fluid communication with an inlet of each of the dedicated evaporators, and regulating the flow of refrigerant from the gas main to the liquid main.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
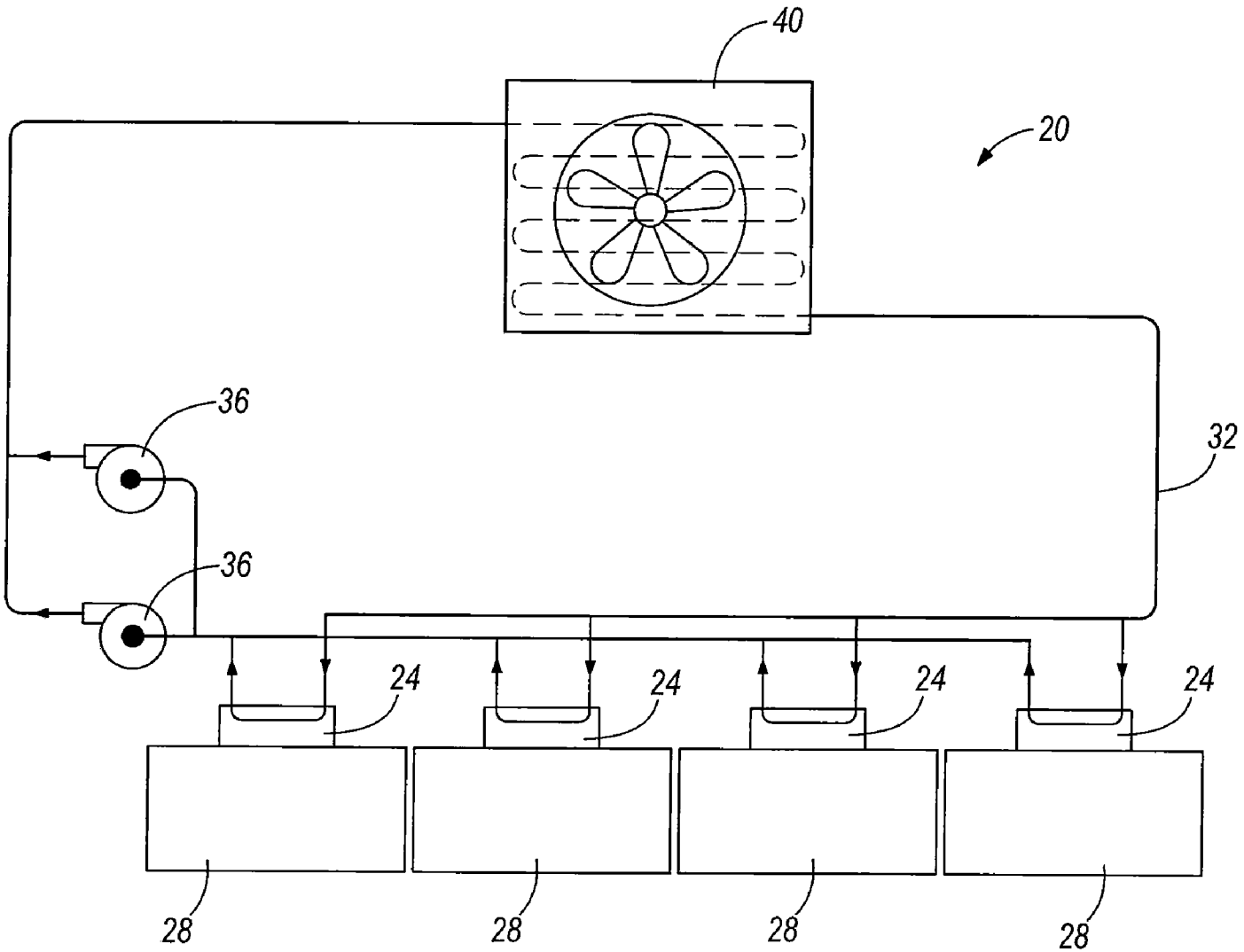
FIG. 1 PRIOR ART
FIG. 1 is a schematic view illustrating a first prior art refrigeration system for refrigerating display cases.
Figure 2:
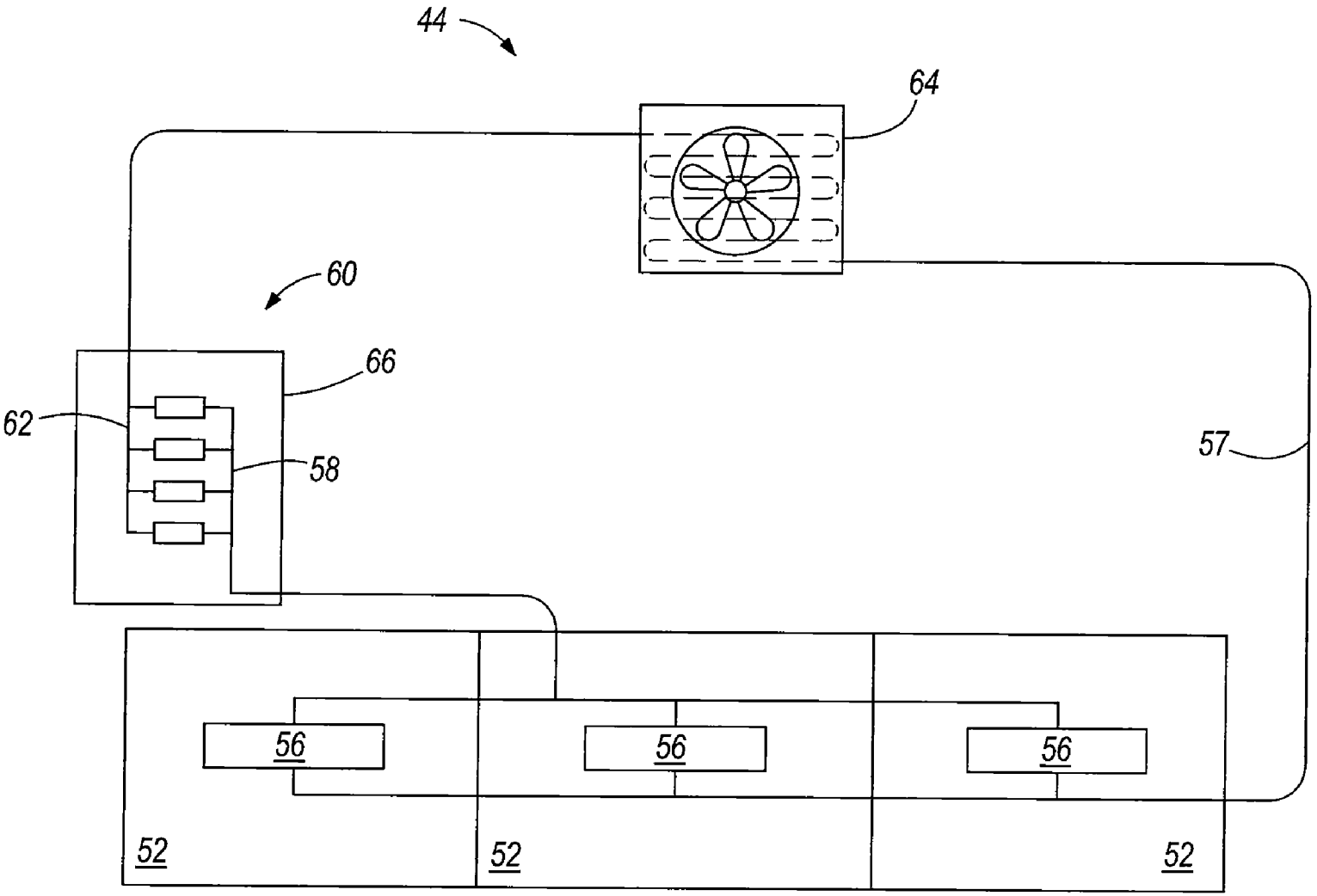
FIG. 2 PRIOR ART
FIG. 2 is a schematic view illustrating a second prior art refrigeration system for refrigerating display cases.
Figure 3:
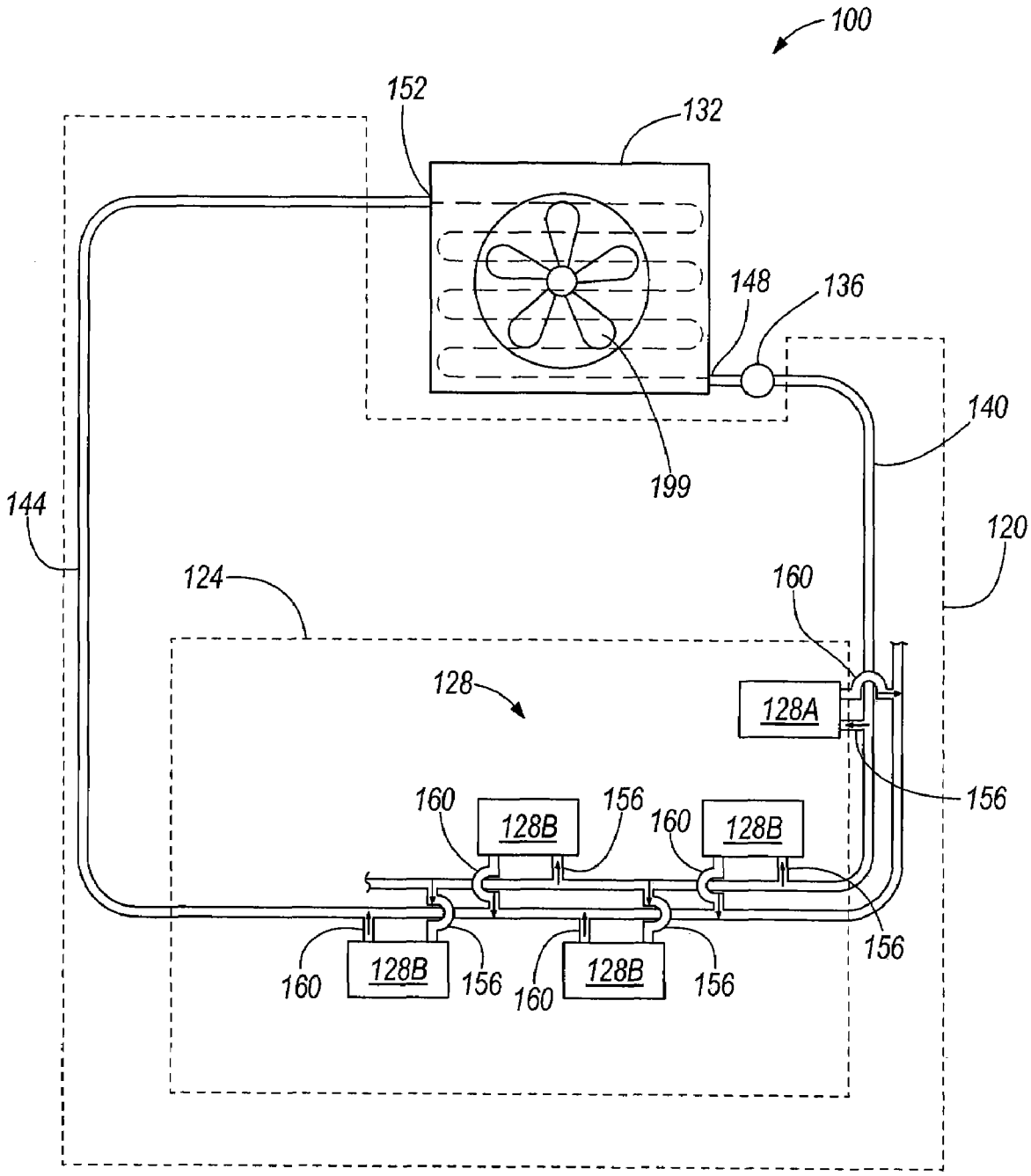
FIG. 3 is a schematic view illustrating a refrigeration system according to one embodiment of the present invention.

FIG. 3 illustrates a refrigeration system 100 according to one embodiment of the present invention for use with a building 120. As illustrated in FIG. 3, the building 120 includes a shopping area 124. As used herein and in the appended claims, the term "shopping area" refers to the commonly accessible area of a supermarket where customers may browse items for sale, and generally does not include any areas designated as equipment, storage, or maintenance areas.

The refrigeration system 100 includes refrigerated display cases 128. The refrigerated display cases 128 are positioned throughout the shopping area 124 of the building 120 for housing and displaying items to be refrigerated. The refrigeration system 100 includes a condenser 132 located outside the building 120 remote from the shopping area 124, a receiver 136, a liquid main 140, and a gas main 144. The condenser 132 may, in some embodiments, be located inside the building 120 but remote from the shopping area 124.

The receiver 136 is in fluid communication between the condenser 132 and the liquid main 140, and is located substantially near the condenser 132 outside the building 120. It should be understood by those of ordinary skill in the art, however, that the receiver 136 can be located anywhere along the liquid main 140 between the condenser 132 and the refrigerated display cases 128 (e.g., within the building 120) without departing from the scope of the present invention. Some embodiments may also include individual receivers located at each compressor unit, rather than one main receiver. Further, In some embodiments, the refrigeration system 100 does not include a receiver.

The condenser 132 has an outlet 148 in fluid communication with the liquid main 140. The condenser 132 also has an inlet 152 in fluid communication with the gas main 144. Each refrigerated display case 128 is fluidly connected to the liquid main 140 via a liquid branch line 156. The liquid branch lines 156 are fluidly connected to the liquid main 140 in parallel with each other. Similarly, the refrigerated display cases 128 are fluidly connected to the gas main 144 via gas branch lines 160 in parallel with each other.

In some embodiments, the liquid main 140 and the gas main 144 are routed throughout the building 120, such that at least a portion of the liquid main 140 and at least a portion of the gas main 144 are positioned adjacent each refrigerated display case 128 of the refrigeration system 100. Positioning at least a portion of both the liquid main 140 and the gas main 144 adjacent each refrigerated display case 128 allows the refrigerated display cases 128 to be installed at a variety of locations in the shopping area 124 by tapping into the liquid main 140 and the gas main 144 with a pair of respective liquid and gas branch lines 156, 160. In some embodiments, the liquid and gas mains 140, 144 may be outside the shopping area 124 adjacent a display case 128A that is near an edge (e.g., a wall) of the shopping area 124. In some embodiments, the liquid and gas mains 140, 144 may extend out into the shopping area 124 adjacent each of a group of more centrally located display cases 128B. In still other embodiments, the store may be divided into "sub-loop" areas with a liquid and gas main and air-cooled condenser for each sub-area of the store. For example one set of liquid and gas mains with an air-cooled condenser for the left side of the store and a separate set of liquid and gas mains and separate air-cooled condenser for the right side of the store. A further embodiment may use such separate sub-loops for different types of refrigerated merchandisers. For example, one set of liquid and gas mains for the meat area, one set for the produce area, etc. Thus, the liquid main 140 and the gas main 144 allow the refrigerated display cases 128 to be positioned throughout the shopping area 124 of the building 120 in a variety of configurations, without requiring extensive routing of lengthy individual liquid and gas branch lines 156, 160, and thereby minimizing the length of the liquid and gas branch lines 156, 160.

The arrangement of the liquid main 140 and gas main 144 throughout the building 120 may simplify the installation procedure of refrigerated display cases 128 or allow for the refrigerated display cases 128 to be easily moved from one location to another within the building 120. The liquid and gas mains 140, 144 may be plumbed into the building 120 (e.g., under the floor or behind walls of the shopping area 124) before any refrigerated display cases 128 are installed. When refrigerated display cases 128 are ready to be installed, they can be added to the refrigeration system 100 by tapping into the liquid and gas mains 140, 144 at a location very near the desired location for the refrigerated display case 128. This eliminates the need for routing lengthy liquid or gas branch lines 156, 160 between each of the refrigerated display cases 128 and a centralized location, remote from the shopping area 124. This also improves the modularity of the shopping area 124, in that the refrigerated display cases 128 can be reconfigured and moved throughout the shopping area 124 without requiring the cumbersome activity of re-routing lengthy liquid and gas branch lines 156, 160.

Figure 4:
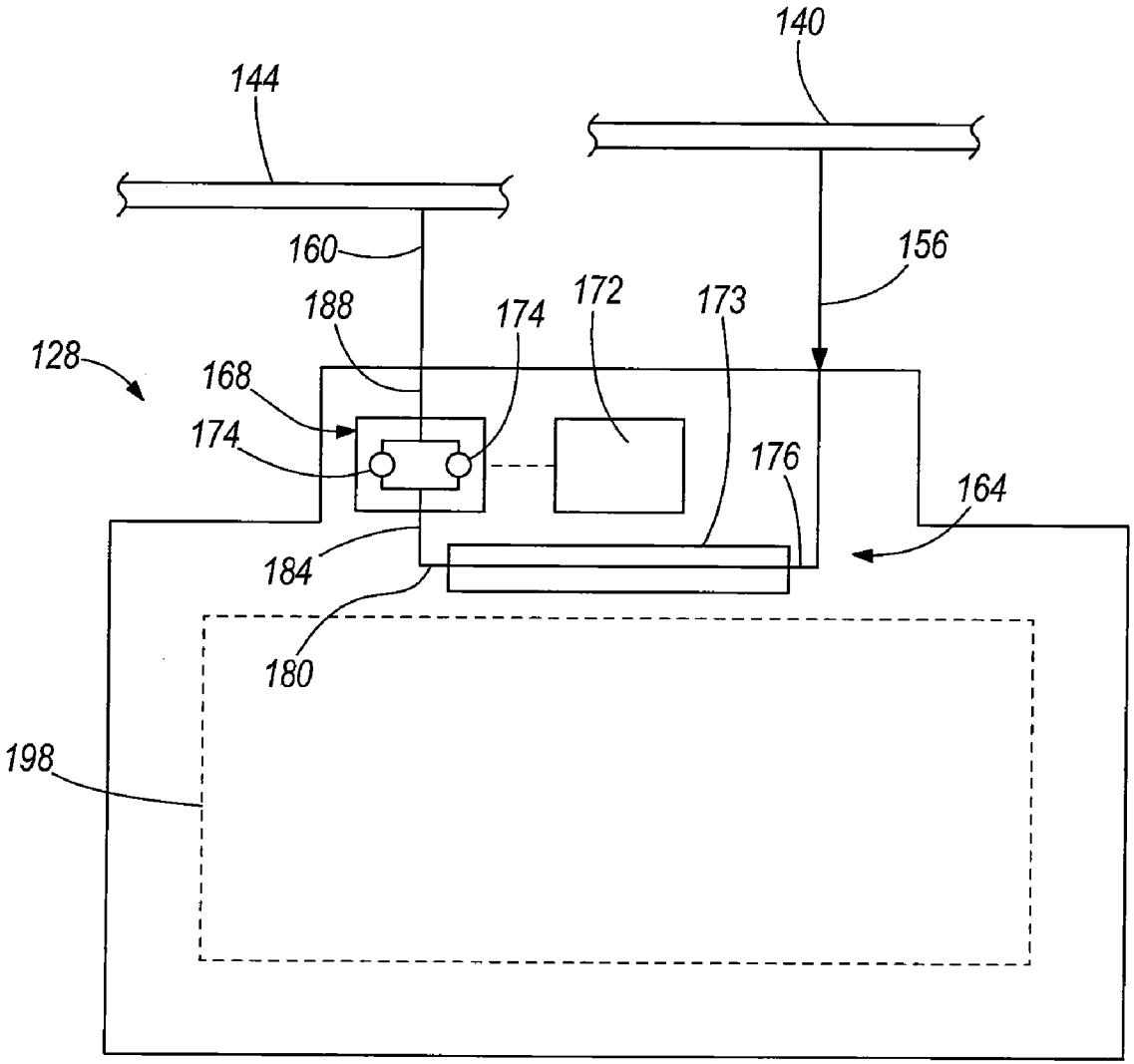
FIG. 4 is a detailed view of the refrigeration system of FIG. 3.

In the embodiment illustrated in FIG. 4, the refrigerated display case 128 includes an evaporator assembly 164, a compressor assembly 168, and a controller 172. (Alternate embodiments may also include an individual receiver for each compressor unit) The evaporator assembly 164, compressor assembly 168, and controller 172 are dedicated to operate only for the refrigerated display case 128. Specifically, a dedicated compressor assembly will only compress refrigerant received from an evaporator assembly of one refrigerated display case. The evaporator assembly 164 can include one or more evaporators 173 to meet the cooling requirements of the refrigerated display case 128. Similarly, the compressor assembly 168 can contain multiple dedicated compressors 174. By way of example only, the illustrated refrigerated display case 128 includes a compressor assembly 168 having two parallel dedicated compressors 174, and an evaporator assembly 164 having a single evaporator 173.

The liquid branch line 156 connects the liquid main 140 to a refrigerant inlet 176 of the evaporator assembly 164. Prior to entering the evaporator assembly 164, the refrigerant will pass through an expansion valve (not shown). In some embodiments, the refrigerant passes through a liquid subcooler which cools the liquid prior to entering the expansion valve. A refrigerant outlet 180 of the evaporator assembly 164 is fluidly connected to an inlet 184 of the compressor assembly 168. In the illustrated embodiment, the evaporator assembly 164 includes a single dedicated evaporator 173. In embodiments employing more than one evaporator, the evaporators of the evaporator assembly 164 can be connected in parallel or series between the liquid branch line 156 and the inlet 184 of the compressor assembly 168.

The evaporator assembly 164 is located such that air passing through the evaporator assembly 164 is discharged to a refrigerated area 198 of the refrigerated display case 128.

The gas branch line 160 connects an outlet 188 of the compressor assembly 168 to the gas main 144. The controller 172 in the refrigerated display case 128 is electrically coupled to the compressor assembly 168. For example, in some embodiments, one or more of the dedicated compressors 174 has a variable capacity. The controller 172 can be electrically coupled to the compressor assembly 168 to modulate the capacity of the variable capacity compressor(s) 174 by adjusting, for example, piston stroke or speed. In such embodiments, the controller 172 can include automatic feedback control and/or can accept user input (e.g., from a keypad, a remote control, etc.). In some embodiments, the controller 172 may be located outside the refrigerated display case 128. In still other embodiments, one controller may serve more then one display case and compressor unit.

Refrigerant flows, in liquid phase, from the receiver 136 to the evaporator assembly 164. At the evaporator assembly 164, heat is transferred from relatively warm air in the refrigerated area 198 to relatively cool liquid refrigerant, causing the refrigerant to evaporate into a gas phase. The gaseous refrigerant is compressed in the compressor assembly 168 as it flows out of the refrigerated display case 128 to the gas main 144 via the gas branch line 160. The gas main 144 carries the refrigerant to the condenser 132.

As shown in FIG. 3, the condenser 132 is air-cooled. A fan 199 forces cooling air across the condenser 132 to cool the refrigerant at least partially back to a liquid phase. The receiver 136 separates the liquid and gaseous phases of the refrigerant and supplies substantially liquid refrigerant to the liquid main 140. In some embodiments of the present invention, the condenser 132 is the sole source of heat rejection from the refrigerant in the refrigeration system 100. In other embodiments, a water cooled condenser, or evaporative condenser may be used.

As shown in FIG. 4, the compressor assembly 168 for each respective refrigerated display case 128 is located within the refrigerated display case 128. In some embodiments, the compressor assembly 168 for each respective refrigerated display case 128 is located adjacent the refrigerated display case 128. In some embodiments, the compressor assembly 168 and the controller 172 are positioned adjacent the refrigerated display case 128 in a separate enclosure. In some embodiments, the compressor assembly 168 and the controller 172 can be positioned directly adjacent an outer wall of the refrigerated display case 128.

In some embodiments, the multiple dedicated compressors 174 located within the compressor assembly 168 (in or adjacent each respective refrigerated display case 128) are the sole means for compressing refrigerant in the refrigeration system 100. This provides a flow path including the gas main, the condenser, and the liquid main, in which there are no active means for pumping or compressing the refrigerant. In some embodiments, the multiple dedicated compressors 174 are oil free thereby doing away with oil distribution subsystems and necessary controls.

In some embodiments, multiple dedicated compressors 174 are dedicated to the refrigerated display case 128. It should be understood by those skilled in the art that multiple dedicated compressors 174 may be arranged in a variety of arrangements (e.g., parallel, series, back-up, etc.) while remaining within the scope of the present invention. When multiple dedicated compressors 174 are used, the multiple compressors 174 can be positioned within the refrigerated display case 128, adjacent the refrigerated display case 128, or combinations thereof.

Figure 5:
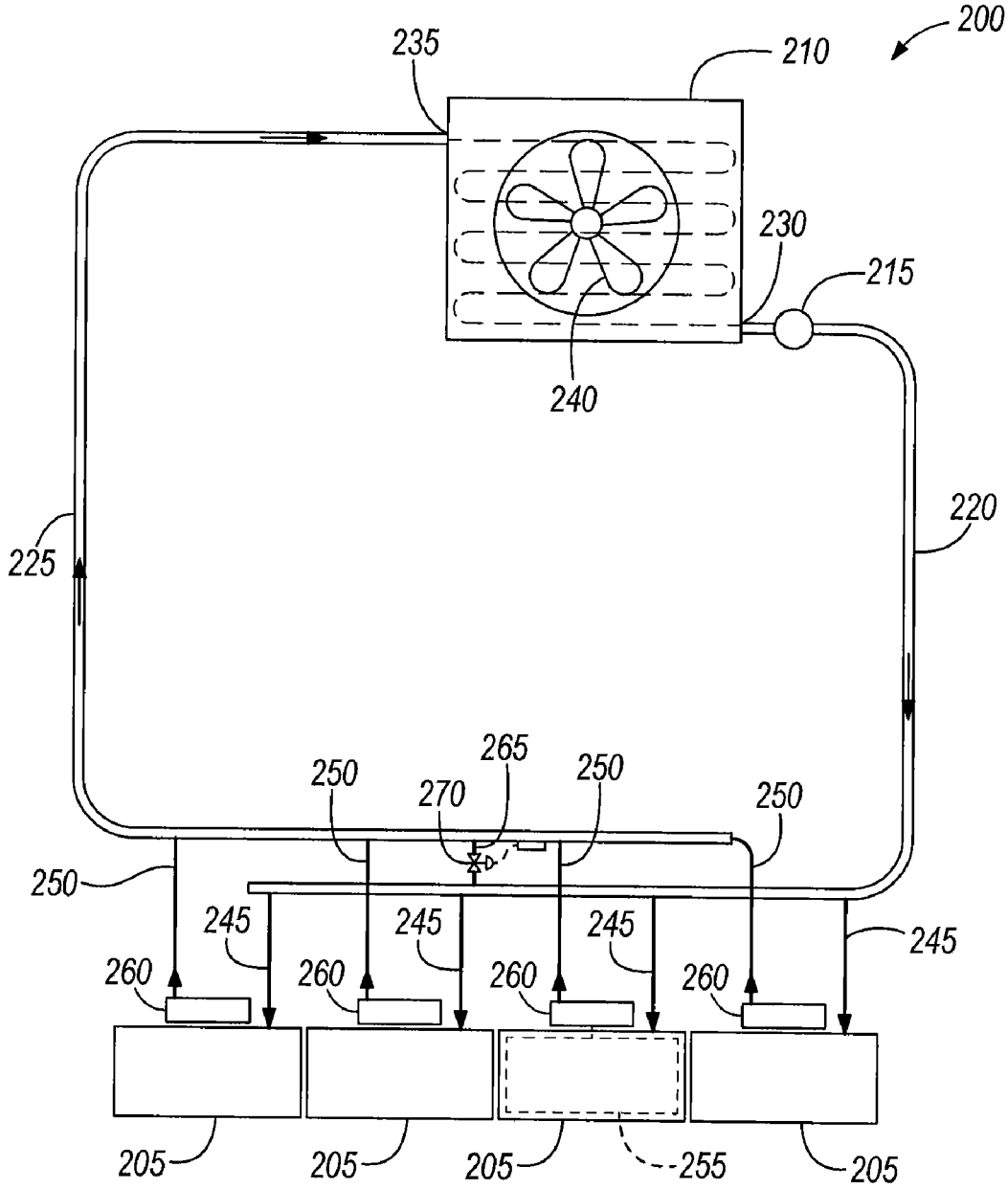
FIG. 5 is a schematic view of another embodiment of a refrigeration system.

FIG. 5 illustrates another embodiment of the invention that includes a refrigeration system 200 for a building. The refrigeration system 200 is similar to the refrigeration system 10 described with regard to FIGS. 3 and 4. The refrigeration system 200 includes refrigerated display cases 205, a condenser 210, a receiver 215, a liquid main 220, and a gas main 225. The refrigerated display cases 205 are similar to the display cases 128 and will not be described in detail. The condenser 210 includes an outlet 230 in fluid communication with the liquid main 220 and an inlet 235 in fluid communication with the gas main 225, and a fan 240 to cool refrigerant from the gas main 225. The condenser 210 is similar to the condenser 132 described above.

The receiver 215 is similar to the receiver 136. As shown in FIG. 5, the receiver 215 is in fluid communication between the condenser 210 and the liquid main 220, and is located substantially near the condenser 230. Other embodiments of the refrigeration system 200 may include a check valve positioned in the bypass line 265 to inhibit flow of liquid refrigerant from the liquid main 220 to the gas main 225. Still other embodiments may position the receiver 215 at a lower elevation within the refrigeration system 200 so that the pressure of the refrigerant within the liquid main 220 is sufficiently low to facilitate drainage of liquid refrigerant from the gas main 225.

The refrigeration system 200 includes a portion of the liquid main 220 positioned vertically below a portion of the gas main 225. Each refrigerated display case 205 is fluidly connected to the liquid main 220 via a liquid branch line 245, with each liquid branch line 245 fluidly connected to the liquid main 220 in parallel with each other. The refrigerated display cases 205 are fluidly connected to the gas main 225 via discharge branch lines 250 in parallel with each other.

Similar to the display cases 128 described with regard to FIGS. 3 and 4, the refrigerated display cases 205 each include an evaporator 255 coupled to a compressor assembly 260. The illustrated embodiment shows a single dedicated evaporator 255 attached to each display case 205. In embodiments employing more than one evaporator, the evaporators 255 can be connected in parallel or series between the liquid branch line 245 and the compressor assembly 260. The illustrated display case 205 also includes a single compressor assembly 260 having one dedicated compressor. The dedicated compressor assembly 260 only compresses refrigerant received from the dedicated evaporator 255 of the respective display case 205. Other embodiments may include a compressor assembly having multiple dedicated compressors. Still other embodiments may include a compressor assembly located remotely from the plurality of display cases.

Figure 6:
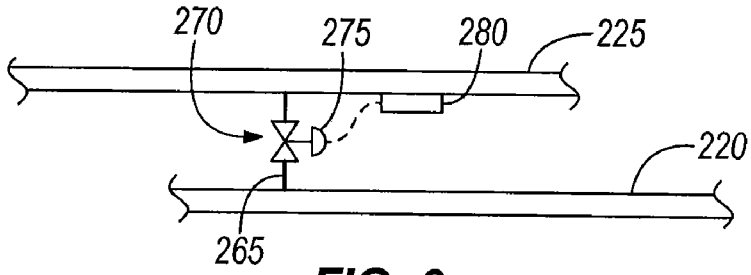
FIG. 6 an enlarged schematic view of the refrigeration system of FIG. 5, including a valve and portions of a liquid main and gas main.

FIGS. 5 and 6 illustrate a bypass line 265 coupled to the portion of the liquid main 220 and the portion of the gas main 225. The bypass line 265 is disposed between the liquid and gas mains 220, 225 to allow refrigerant to bypass the condenser 210.

A valve 270 is coupled to the bypass line 265 to regulate flow of refrigerant from the gas main 225 to the liquid main 220 through the bypass line 265. The valve 270 includes an open position and a closed position, and includes a pressure sensor 275 and a temperature sensor 280. The pressure sensor 275 measures the pressure of refrigerant in the portion of the gas main 225. The temperature sensor 280 measures the temperature of refrigerant in the portion of the gas main 225. The sensed pressure and temperature of the refrigerant cooperate to define a superheat of the refrigerant. Specifically, the superheat is defined by a temperature of the refrigerant with respect to the saturation temperature of the refrigerant. The illustrated embodiment of the valve 270 includes mechanical sensors that do not require separate wiring or other electrical connections to sense superheat of the refrigerant in the portion of the gas main 225. Alternatively, the valve 270 may include sensors that may be electrically coupled to the valve to sense superheat of refrigerant. In other embodiments, the valve 270 may include a single sensor to measure the superheat of the refrigerant in the gas main 225.

In some embodiments, the valve 270 includes a reverse-acting thermostatic expansion valve. Generally, thermostatic expansion valves, such as valve 270, react to superheat of refrigerant in a refrigeration system to regulate refrigerant flow. Direct-acting thermostatic expansion valves (i.e., not reverse-acting) are often used in refrigeration systems to control refrigerant flow through an evaporator. For example, a direct-acting thermostatic expansion valve is positioned downstream of the evaporator in the suction line of the refrigeration system to sense superheat of refrigerant in the suction line. The direct-acting valve opens when superheat of refrigerant in the suction line is high to increase refrigerant flow through the evaporator, and closes when superheat of refrigerant in the suction line is low to decrease refrigerant flow through the evaporator. Opening and closing the direct-acting valve maximizes the heat transfer between the refrigerant and the cooling air passing over the evaporator while assuring that refrigerant exiting the evaporator is substantially in a gaseous state.

The reverse-acting valve 270 regulates the flow of refrigerant from the gas main 225 to the liquid main 220 based on superheat of refrigerant in the gas main 225. The reverse-acting valve 270 operates inversely to the operation of direct-acting thermostatic expansion valves. Specifically, the reverse-acting valve 270 tends to close when superheat of refrigerant in the portion of the gas main 225 is high. The reverse-acting valve tends to close when the superheat of refrigerant in the portion of the gas main 225 is low. Refrigerant in the gas main 225 that has a high superheat is defined by a relatively larger amount of gaseous refrigerant. Refrigerant in the gas main 225 that has a low superheat is defined by a relatively larger amount of liquid refrigerant. Sensing of the superheat of refrigerant in the gas main 225 by the sensors 275, 280 allows the valve 270 to selectively vary between the open and closed positions to drain liquid refrigerant from the gas main 225 and to bypass the condenser 210 at various condensing pressures and temperatures.

When the refrigeration system 200 is initially started, the gas main 225 is relatively cool. Cool ambient temperatures lower the temperature of the gas main 225 and may cause refrigerant in the gas main 225 to at least partially liquefy, limiting the refrigerant available in the liquid main 220 and in remaining portions of the refrigeration system 200. The pressure sensor 275 and the temperature sensor 280 sense the pressure and temperature of refrigerant, respectively, in the gas main 225. The valve 270 opens and closes in response to the sensed superheat. The valve 270 drains liquid refrigerant from the portion of the gas main 225 to the portion of the liquid main 220 in response to a low superheat of the refrigerant in the gas main 225. The liquid refrigerant that flows from the gas main 225 into the liquid main 220 bypasses the condenser 210 and enters the evaporator 255. The valve 270 opens to drain liquefied refrigerant when the superheat of the gas main 225 is low. As the superheat of refrigerant in the gas main 225 increases (i.e., the sensors 275, 280 sense an increase in temperature relative to the saturation temperature of the refrigerant), less refrigerant remains in the gas main 225 in liquid form. The valve 270 tends to close in response to increased superheat of the refrigerant to drain any remaining liquid refrigerant in the portion of the gas main 225 and to inhibit flow of gaseous refrigerant through the bypass line 265.

Thus, the invention provides, among other things, a control valve to regulate flow of refrigerant within a refrigeration system, and more specifically, to selectively drain refrigerant from a gas main to a liquid main. Various features and advantages of the invention are set forth in the following claims.

What is claimed is:

1. A refrigeration system comprising:

a plurality of refrigerated display cases, each of the plurality of refrigerated display cases including a dedicated evaporator configured to cool return air from the respective refrigerated display case by at least partially evaporating a refrigerant;

a compressor assembly in fluid communication with the plurality of evaporators and configured to compress evaporated refrigerant from the plurality of evaporators;

a condenser located remotely from the plurality of refrigerated display cases and configured to reject heat from the refrigerant to an environment, the condenser including an inlet and an outlet;

a gas main in fluid communication with the inlet and configured to direct refrigerant from the compressor assembly to the condenser;

a liquid main in fluid communication with the outlet and configured to direct refrigerant from the condenser to the plurality of evaporators; and a valve fluidly coupled between the gas main and the liquid main and including at least one sensor configured to measure the superheat of refrigerant in the gas main, the valve configured to regulate flow of the refrigerant from the gas main to the liquid main based on the superheat of refrigerant in the gas main.

2. The refrigeration system of claim 1, wherein the valve is configured to regulate refrigerant flow from the gas main to the liquid main by bypassing the condenser.

3. The refrigeration system of claim 1, wherein the valve is fluidly coupled between a portion of the gas main and a portion of the liquid main that is disposed vertically below the portion of the gas main, the valve configured to selectively drain refrigerant from the portion of the gas main to the portion of the liquid main.

4. The refrigeration system of claim 1, wherein the at least one sensor includes a pressure sensor and a temperature sensor, wherein the pressure sensor is configured to sense the pressure of the refrigerant in the gas main, and wherein the temperature sensor is configured to sense the temperature of the refrigerant in the gas main.

5. The refrigeration system of claim 1, wherein the valve is configured to open when the superheat of the refrigerant in the gas main is low and close when the superheat of the refrigerant in the gas main is high.

6. The refrigeration system of claim 1, wherein the compressor assembly includes at least one dedicated compressor for each of the plurality of refrigerated display cases.

7. The refrigeration system of claim 6, wherein the at least one dedicated compressor assembly is configured to compress evaporated refrigerant from the dedicated evaporator of a single refrigerated display case.

8. The refrigeration system of claim 6, wherein the plurality of dedicated evaporators is connected to the liquid main in parallel, and wherein the plurality of dedicated compressor assemblies is connected to the gas main in parallel.

9. The refrigeration system of claim 1, wherein the valve includes a reverse-acting thermostatic expansion valve.

10. A method of operating a refrigeration system including a plurality of refrigerated display cases each having a dedicated evaporator, the method comprising:

cooling return air from each of the plurality of refrigerated display cases by at least partially evaporating a refrigerant in each of the dedicated evaporators;

compressing the evaporated refrigerant;

directing the compressed refrigerant through a gas main in fluid communication with a condenser;

condensing the compressed refrigerant in the condenser; directing the condensed refrigerant through a liquid main in fluid communication with an inlet of each of the dedicated evaporators;

regulating a flow of refrigerant from the gas main to the liquid main;

sensing a superheat of refrigerant in the gas main; and selectively draining refrigerant from the gas main to the liquid main.

11. The method of claim 10, further comprising at least partially filling the gas main with liquid refrigerant at startup of the refrigeration system, and reducing an amount of refrigerant available in the liquid main at startup of the refrigeration system.

12. The method of claim 11, wherein at least partially filling the gas main includes at least partially condensing refrigerant in the gas main at startup of the refrigeration system.

13. The method of claim 10, wherein sensing the superheat of the refrigerant in the gas main includes sensing a refrigerant pressure and sensing a refrigerant temperature.

14. The method of claim 10, wherein selectively draining refrigerant from the gas main to the liquid main includes draining condensed refrigerant from the gas main, and bypassing the condenser.

15. The method of claim 14, wherein draining the condensed refrigerant from the gas main includes draining condensed refrigerant at more than one sensed superheat.

16. The method of claim 10, wherein selectively draining refrigerant from the gas main to the liquid main includes opening a valve when the superheat of the refrigerant in the gas main is low, and closing the valve when the superheat of the refrigerant in the gas main is high.

17. The method of claim 10, further comprising connecting the plurality of dedicated evaporators in parallel with the liquid main, and connecting a plurality of dedicated compressor assemblies in parallel with the gas main, wherein providing the dedicated compressor assembly includes compressing evaporated refrigerant from the dedicated evaporator of a single refrigerated display case.

18. The method of claim 10, wherein regulating the flow of refrigerant from the gas main to the liquid main includes inhibiting flow of superheated refrigerant in the gas main to the liquid main.

* * * * *

UNITED STATES PATENT AND TRADEMARK OFFICE

CERTIFICATE OF CORRECTION

PATENT NO. : 7,574,869 B2
APPLICATION NO. : 11/457081
DATED : August 18, 2009
INVENTOR(S) : Doron Shapiro It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 519 days.

Signed and Sealed this

Seventh Day of September, 2010

David J. Kappos

David J. Kappos
*Director of the United States Patent and Trademark Office*